US008610600B1

(12) United States Patent
Sobel

(10) Patent No.: US 8,610,600 B1
(45) Date of Patent: Dec. 17, 2013

(54) TECHNIQUES FOR PROVIDING MISSED ARRIVAL NOTIFICATIONS

(75) Inventor: William E. Sobel, Jamul, CA (US)

(73) Assignee: Symantec Corporation, Mountain View, CA (US)

( * ) Notice: Subject to any disclaimer, the term of this patent is extended or adjusted under 35 U.S.C. 154(b) by 322 days.

(21) Appl. No.: 13/045,971

(22) Filed: Mar. 11, 2011

(51) Int. Cl.
*G08G 1/123* (2006.01)

(52) U.S. Cl.
USPC ..... 340/994; 340/989; 701/465

(58) Field of Classification Search
USPC ..... 340/994, 991, 989, 995.1, 995.13, 340/995.19; 342/357, 357.31, 357.75; 701/456, 454, 465
See application file for complete search history.

(56) References Cited

U.S. PATENT DOCUMENTS 5,987,377 A * 11/1999 Westerlage et al. ..... 701/454
6,741,187 B2 * 5/2004 Flick ..... 340/989
2003/0193413 A1 * 10/2003 Jones ..... 340/994
2005/0219056 A1 * 10/2005 McHugh et al. ..... 340/573.4
2007/0024469 A1 * 2/2007 Chou ..... 340/994

* cited by examiner

*Primary Examiner* — Anh V La

(74) *Attorney, Agent, or Firm* — Wilmer Cutler Pickering Hale and Dorr LLP

(57) ABSTRACT

Techniques for providing missed arrival notifications are disclosed. In one particular exemplary embodiment, the techniques may be realized as a method for providing missed arrival notifications comprising: receiving, from a user associated with a client device, travel information that indicates at least an expected destination and an expected route to the expected destination, tracking, on a notification system, the client device's progress in traveling the expected route to the expected destination, determining, on the notification system, whether the client device has deviated from the expected route to the expected destination, and initiating, on the notification system, an alert escalation procedure in response to determining that the client device has deviated from the expected route to the expected destination.

20 Claims, 7 Drawing Sheets

500

600

TECHNIQUES FOR PROVIDING MISSED ARRIVAL NOTIFICATIONS

FIELD OF THE DISCLOSURE

The present disclosure relates generally to arrival notifications and, more particularly, to techniques for providing missed arrival notifications.

BACKGROUND OF THE DISCLOSURE

In recent years, many countries around the world have experienced unrest among their populations. In some instances, such unrest is the result of political clashes among political parties that support diverging political policies. In other instances, such unrest is the result of religious clashes among religious sects that support diverging religious views. Many of these countries have also experienced a rise in traditional kidnappings (e.g., a victim is held for a long period of time) and express kidnappings (e.g., a victim is held for a short period of time and taken to an Automatic Teller Machine (ATM) to withdraw funds) due to the political climate and the religious climate within their borders. These countries, however, have not implemented systems directed towards limiting the amount of successful kidnappings.

In view of the foregoing, it may be understood that there may be significant problems and shortcomings associated with kidnapping notification technologies.

SUMMARY OF THE DISCLOSURE

Techniques for providing missed arrival notifications are disclosed. In one particular exemplary embodiment, the techniques may be realized as a method for providing missed arrival notifications comprising: receiving, from a user associated with a client device, travel information that indicates at least an expected destination and an expected route to the expected destination, tracking, on a notification system, the client device's progress in traveling the expected route to the expected destination, determining, on the notification system, whether the client device has deviated from the expected route to the expected destination, and initiating, on the notification system, an alert escalation procedure in response to determining that the client device has deviated from the expected route to the expected destination.

In accordance with other aspects of this particular exemplary embodiment, the travel information may indicate an expected time of arrival.

In accordance with further aspects of this particular exemplary embodiment, the expected destination may include a geographic location that is associated with geographic coordinates.

In accordance with additional aspects of this particular exemplary embodiment, tracking may further include receiving one or more progress updates from the client device.

In accordance with other aspects of this particular exemplary embodiment, determining may further include comparing the expected route to an actual route.

In accordance with further aspects of this particular exemplary embodiment, the actual route may be derived based on the one or more progress updates.

In accordance with additional aspects of this particular exemplary embodiment, determining may further include applying a narrow travel range to the actual route.

In accordance with other aspects of this particular exemplary embodiment, determining may further include applying a wide travel range to the actual route.

In accordance with further aspects of this particular exemplary embodiment, the alert escalation procedure may include a first alert level, a second alert level, and a third alert level.

In accordance with additional aspects of this particular exemplary embodiment, the first alert level may include transmitting an alert to the client device to request a response from the user.

In accordance with other aspects of this particular exemplary embodiment, the second alert level may include transmitting one or more alerts to one or more third party systems.

In accordance with further aspects of this particular exemplary embodiment, the third alert level may include notifying an authority near a current location of the client device.

In accordance with additional aspects of this particular exemplary embodiment, the techniques may be realized as at least one non-transitory processor readable storage medium for storing a computer program of instructions configured to be readable by at least one processor for instructing the at least one processor to execute a computer process.

In another particular exemplary embodiment, the techniques may be realized as an article of manufacture for providing missed arrival notifications, the article of manufacture comprising: at least one non-transitory processor readable medium, and instructions stored on the at least one medium, wherein the instructions are configured to be readable from the at least one medium by at least one processor and thereby cause the at least one processor to operate so as to: receive, from a user associated with a client device, travel information that indicates at least an expected destination and an expected route to the expected destination, track, on a notification system, the client device's progress in traveling the expected route to the expected destination, determine, on the notification system, whether the client device has deviated from the expected route to the expected destination, and initiate, on the notification system, an alert escalation procedure in response to determining that the client device has deviated from the expected route to the expected destination.

In another particular exemplary embodiment, the techniques may be realized as a system for providing missed arrival notifications system comprising: one or more processors communicatively coupled to a network, wherein the one or more processors are configured to: receive, from a user associated with a client device, travel information that indicates at least an expected destination and an expected route to the expected destination, track, on a notification system, the client device's progress in traveling the expected route to the expected destination, determine, on the notification system, whether the client device has deviated from the expected route to the expected destination, and initiate, on the notification system, an alert escalation procedure in response to determining that the client device has deviated from the expected route to the expected destination.

In accordance with other aspects of this particular exemplary embodiment, the travel information may indicate an expected time of arrival.

In accordance with further aspects of this particular exemplary embodiment, the expected destination may include a geographic location that is associated with geographic coordinates.

In accordance with additional aspects of this particular exemplary embodiment, the one or more processors may be further configured to track by receiving one or more progress updates from the client device.

In accordance with other aspects of this particular exemplary embodiment, the one or more processors may be further configured to determine by comparing the expected route to an actual route.

In accordance with further aspects of this particular exemplary embodiment, the actual route may be derived based on the one or more progress updates.

The present disclosure will now be described in more detail with reference to exemplary embodiments thereof as shown in the accompanying drawings. While the present disclosure is described below with reference to exemplary embodiments, it should be understood that the present disclosure is not limited thereto. Those of ordinary skill in the art having access to the teachings herein will recognize additional implementations, modifications, and embodiments, as well as other fields of use, which are within the scope of the present disclosure as described herein, and with respect to which the present disclosure may be of significant utility.

BRIEF DESCRIPTION OF THE DRAWINGS

In order to facilitate a fuller understanding of the present disclosure, reference is now made to the accompanying drawings, in which like elements are referenced with like numerals. These drawings should not be construed as limiting the present disclosure, but are intended to be exemplary only.

DETAILED DESCRIPTION OF EXEMPLARY EMBODIMENTS

Figure 1:
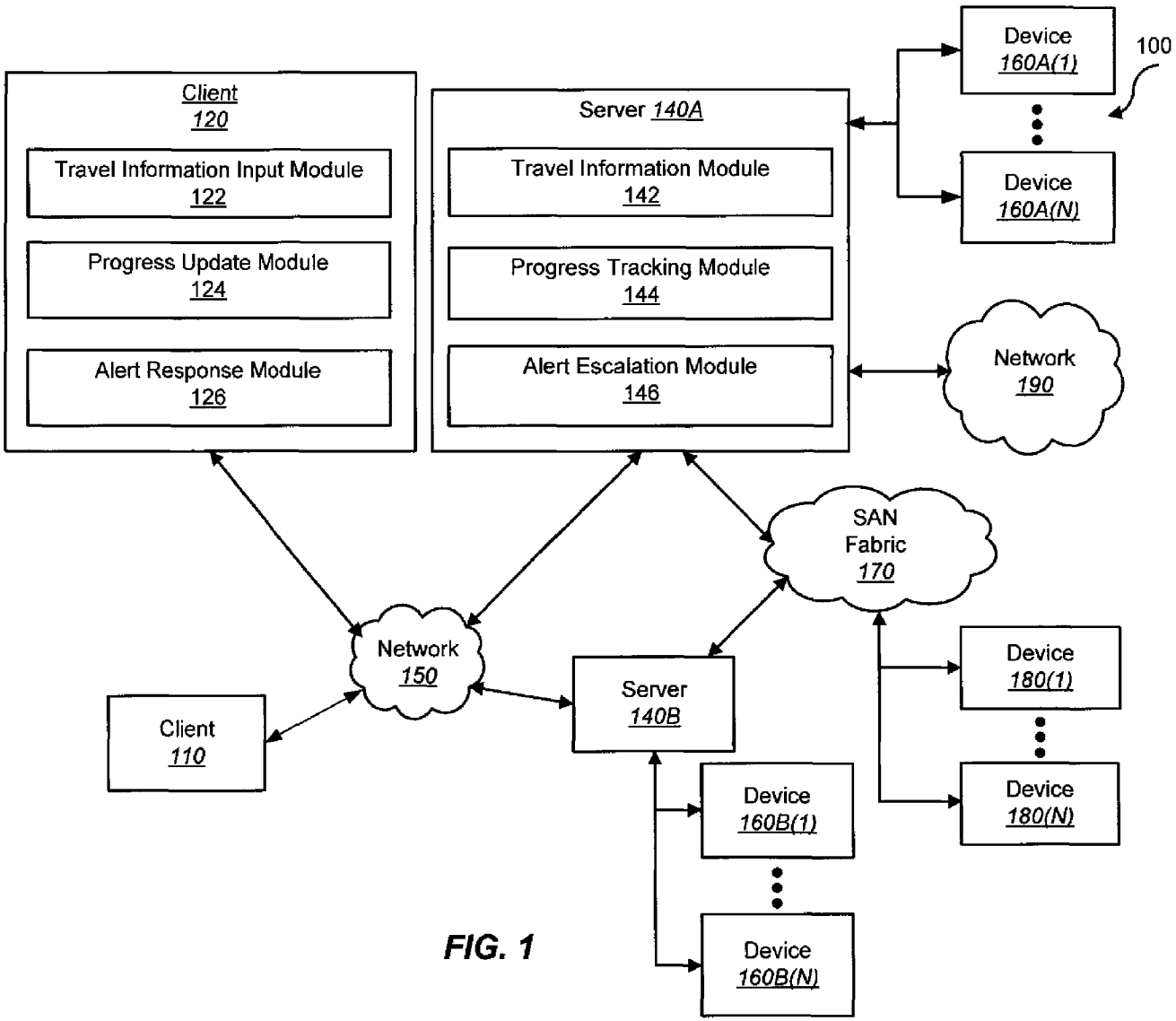
FIG. 1 shows a block diagram depicting a network architecture containing a platform for providing missed arrival notifications in accordance with an embodiment of the present disclosure.

Currently, a traveler to a foreign country may inform other individuals (e.g., family members, coworkers) of their expected itinerary (e.g., one or more expected destinations, one or more expected time of arrivals) as a safety precaution. If, for example, one of the informed individuals is unable to reach the traveler at an expected destination (e.g., a hotel) at an expected time, the individual may alert authorities, travel companions, or other family members in an attempt to locate the traveler and ensure the traveler's safety. Such a safety precaution, however, is grossly inefficient.

In one embodiment, certain techniques for providing missed arrival notifications are provided. In such an embodiment, a notification system (e.g., a server) may be communicatively coupled to a client device of a traveler. Accordingly, a traveler may enlist the missed arrival notification services provided by the notification system by subscribing to receive such missed arrival notification services.

Once a traveler has subscribed to receive the missed arrival notification services (e.g., creating an account, creating a username to access the account, creating a password to access the account), the traveler may input travel information into the notification system via the client device. Travel information may include any data that indicates any, or a combination, of an expected destination, an expected route to an expected destination, and an expected time of arrival.

Based on the travel information received, the notification system may initiate a tracking process that tracks the traveler's progress (e.g., the client device's progress) in traveling to the expected destination. The tracking process may include receiving one or more progress updates (e.g., Global Position System (GPS) updates) from the client device as the client device travels to the expected destination. In one embodiment, the tracking progress may be configured to track that the client device is generally headed toward the expected destination over time. In such an embodiment, the tracking process may track the progress of the client device in moving closer to the expected destination from one point-in-time to another point-in-time (e.g., a later point-in-time). In another embodiment, the tracking process may be configured to track the traveler's progress on an expected route to the expected destination. In such an embodiment, the tracking process may track the progress of the client device in moving from one sub-destination (e.g., a destination along an expected route to an expected destination) to another sub-destination along the expected route to the expected destination. In another embodiment, the tracking process may be configured to determine whether the traveler arrived at an expected destination by an expected arrival time.

In certain embodiments, the notification system may determine whether the client device has deviated from an expected route to an expected destination. Accordingly, the notification system may continuously compare an actual route of the client device (e.g., based on the progress updates provided) to an expected route of the client device. If, for example, the notification system determines that the client device has deviated (e.g., by applying a narrow travel range, by applying a wide travel range) from the expected route, an alert escalation procedure may be invoked.

The alert escalation procedure may include a first alert level, a second alert level, and a third alert level. In some embodiments, the alert escalation procedure may be configured to start at the first alert level, move next to the second alert level, and end at the third alert level. In other embodiments, the alert escalation procedure may be configured to start or end at any of the first alert level, the second alert level, and the third alert level. In one embodiment, the first alert level may include transmitting an alert to the client device requesting that the traveler input a code (e.g., a security code). In such an embodiment, if the traveler fails to input the code (e.g., within a predetermined amount of time), the alert escalation procedure may proceed to the second alert level. In such an embodiment, if the traveler inputs a covert distress signal (e.g., by pressing a particular button), the alert escalation procedure may immediately notify one or more authorities (e.g., police authorities near the client device's current location).

In another embodiment, the second alert level may include transmitting an alert to one or more third party systems (e.g., systems belonging to travel companions associated with the traveler, systems belonging to family members of the traveler, systems belonging to coworkers of the traveler, systems belonging to hotel workers located at a hotel at which the traveler is scheduled to stay). In such an embodiment, the users of the third party systems may attempt to contact the traveler. If such contact is successful and the traveler is not in danger, the alert escalation procedure may end. If such contact is not successful, the alert escalation procedure may proceed to the third alert level.

In another embodiment, the third alert level may include notifying one or more authorities near a current location of the traveler. In such an embodiment, the current location of the traveler may be derived from one or more progress updates provided by the client device.

The notification system may also be configured to initiate an alert escalation procedure in the event the traveler fails to arrive at an expected destination by an expected time of arrival. Prior to initiating the alert escalation procedure and near the expected time of arrival, the notification system may request that traveler indicate whether they have arrived at the expected destination using the client device (e.g., by entering a code). If, for example, the traveler indicates that they have arrived at the expected destination, the notification system may not invoke the alert escalation procedure. If, however, the traveler fails to indicate that they have arrived at the expected destination, the notification system may invoke the alert escalation procedure described above.

FIG. 1 shows a block diagram depicting a network architecture 100 containing a platform for providing missed arrival notifications in accordance with an embodiment of the present disclosure. FIG. 1 is a simplified view of network architecture 100, which may include additional elements that are not depicted. Network architecture 100 may contain client 110, client 120, server 140A, as well as server 140B (one or more of which may be implemented using computer system 200 shown in FIG. 2). Client 110, client 120, server 140A, and server 140B may be communicatively coupled to a network 150. Server 140A may be communicatively coupled to storage devices 160A(1)-(N), and server 140B may be communicatively coupled to storage devices 160B(1)-(N). Server 140A may contain one or more modules for providing missed arrival notifications including an a travel information module 142, a progress tracking module 144, and an alert escalation module 146. Server 140A and server 140B may be communicatively coupled to a SAN (Storage Area Network) fabric 170. SAN fabric 170 may support access to storage devices 180(1)-(N) by server 140A and server 140B, and by client 110 and client 120 via network 150. Server 140A may be communicatively coupled to network 190. Client 120 may contain one or more modules for providing missed arrival notifications including a travel information input module 122, a progress update module 124, and an alert response module 126.

Figure 2:
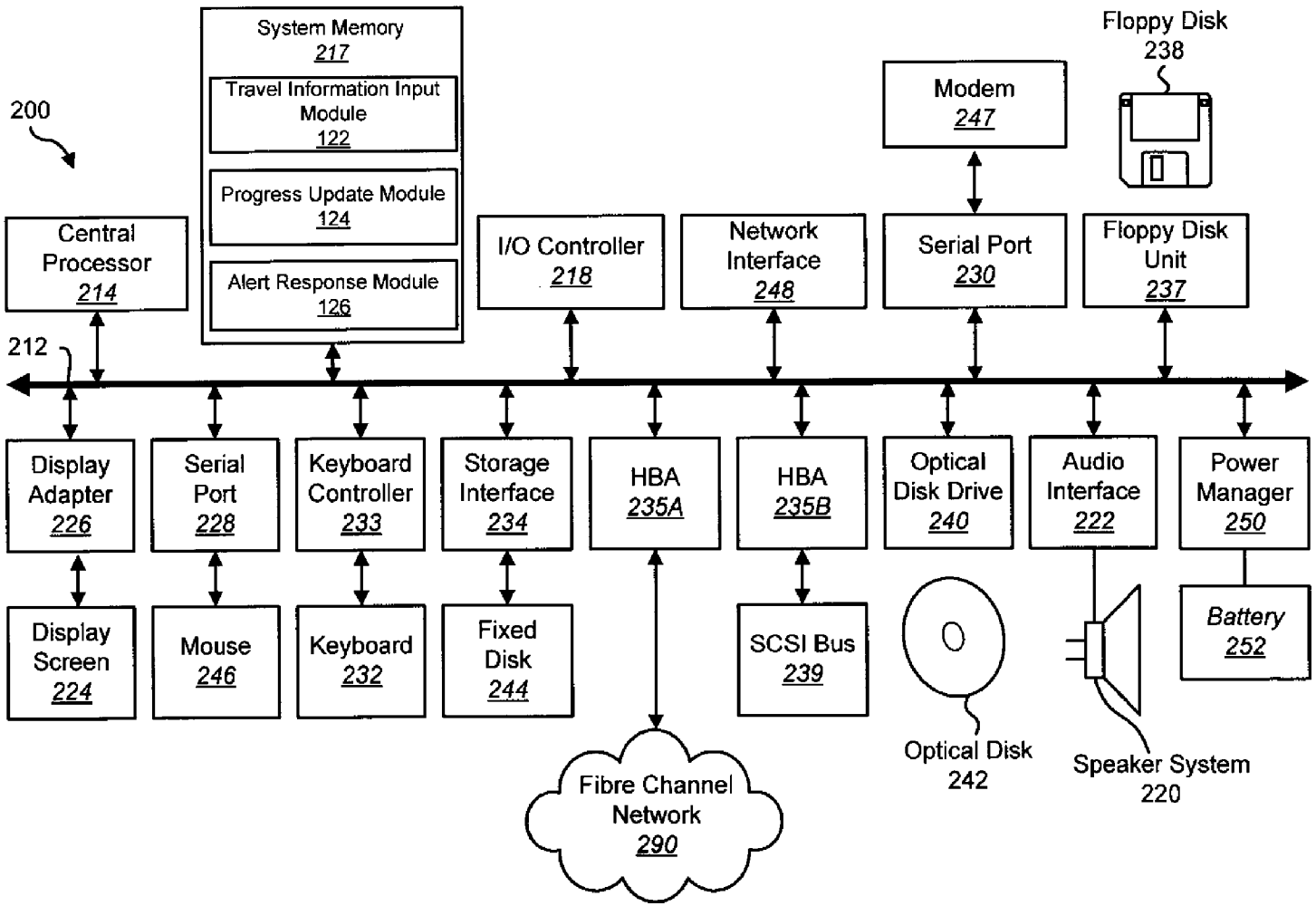
FIG. 2 depicts a block diagram of a computer system in accordance with an embodiment of the present disclosure.

With reference to computer system 200 of FIG. 2, modem 247, network interface 248, or some other method may be used to provide connectivity from one or more of client 110 and client 120 to network 150. Client 120 may be able to access information on server 140A or server 140B using, for example, a web browser or other client software. Such a client may allow client 120 to access data hosted by server 140A or server 140B or one of storage devices 160A(1)-(N), 160B(1)-(N), and/or 180(1)-(N).

Networks 150 and 190 may be local area networks (LANs), wide area networks (WANs), the Internet, cellular networks, satellite networks, or other networks that permit communication between client 110, client 120, server 140A, server 140B, and other devices communicatively coupled to networks 150 and 190. Networks 150 and 190 may further include one, or any number, of the exemplary types of networks mentioned above operating as a stand-alone network or in cooperation with each other. Networks 150 and 190 may utilize one or more protocols of one or more clients or servers to which they are communicatively coupled. Networks 150 and 190 may translate to or from other protocols to one or more protocols of network devices. Although networks 150 and 190 are each depicted as one network, it should be appreciated that according to one or more embodiments, networks 150 and 190 may each comprise a plurality of interconnected networks.

Storage devices 160A(1)-(N), 160B(1)-(N), and/or 180(1)-(N) may be network accessible storage and may be local, remote, or a combination thereof to client 110, client 120, server 140A, or server 140B. Storage devices 160A(1)-(N), 160B(1)-(N), and/or 180(1)-(N) may utilize a redundant array of inexpensive disks ("RAID"), magnetic tape, disk, a storage area network ("SAN"), an internet small computer systems interface ("iSCSI") SAN, a Fibre Channel SAN, a common Internet File System ("CIFS"), network attached storage ("NAS"), a network file system ("NFS"), optical based storage, or other computer accessible storage. Storage devices 160A(1)-(N), 160B(1)-(N), and/or 180(1)-(N) may be used for backup, replication, or archival purposes.

According to some embodiments, client 110 and client 120 may be a smartphone, PDA, desktop computer, a laptop computer, a server, another computer, or another device coupled via a wireless or wired connection to network 150. Client 110 and client 120 may receive data from user input, a database, a file, a web service, and/or an application programming interface.

Server 140A and server 140B may be application servers, archival platforms, backup servers, backend servers, network storage devices, media servers, email servers, document management platforms, enterprise search servers, or other devices communicatively coupled to network 150. Server 140A and server 140B may utilize one of storage devices 160A(1)-(N), 160B(1)-(N), and/or 180(1)-(N) for the storage of application data, replication data, backup data, or other data. Server 140A and server 140B may be hosts, such as an application server, which may process data traveling between client 110 and client 120 and a backup platform, a backup process, and/or storage. According to some embodiments, server 140A and server 140B may be platforms used for backing up and/or archiving data.

Travel information module 122, progress update module 124, alert response module 126, travel information module 142, progress tracking module 144, and alert escalation module 146 are discussed in further detail below.

FIG. 2 depicts a block diagram of a computer system 200 in accordance with an embodiment of the present disclosure. Computer system 200 is suitable for implementing techniques in accordance with the present disclosure. Computer system 200 may include a bus 212 which may interconnect major subsystems of computer system 200, such as a central processor 214, a system memory 217 (e.g. RAM (Random Access Memory), ROM (Read Only Memory), flash RAM, or the like), an Input/Output (I/O) controller 218, an external audio device, such as a speaker system 220 via an audio output interface 222, an external device, such as a display screen 224 via display adapter 226, serial ports 228 and 230, a keyboard 232 (interfaced via a keyboard controller 233), a storage interface 234, a floppy disk drive 237 operative to receive a floppy disk 238, a host bus adapter (HBA) interface card 235A operative to connect with a Fibre Channel network 290, a host bus adapter (HBA) interface card 235B operative to connect to a SCSI bus 239, and an optical disk drive 240 operative to receive an optical disk 242. Also included may be a mouse 246 (or other point-and-click device, coupled to bus 212 via serial port 228), a modem 247 (coupled to bus 212 via serial port 230), network interface 248 (coupled directly to bus 212), power manager 250, and battery 252.

Bus 212 allows data communication between central processor 214 and system memory 217, which may include read-only memory (ROM) or flash memory (neither shown), and random access memory (RAM) (not shown), as previously noted. The RAM may be the main memory into which the operating system and application programs may be loaded. The ROM or flash memory can contain, among other code, the Basic Input-Output system (BIOS) which controls basic hardware operation such as the interaction with peripheral components. Applications resident with computer system 200 may be stored on and accessed via a computer readable medium, such as a hard disk drive (e.g., fixed disk 244), an optical drive (e.g., optical drive 240), a floppy disk unit 237, or other storage medium. For example, travel information input module 122, progress update module 124, and alert response module 126 may be resident in system memory 217.

Storage interface 234, as with the other storage interfaces of computer system 200, can connect to a standard computer readable medium for storage and/or retrieval of information, such as a fixed disk drive 244. Fixed disk drive 244 may be a part of computer system 200 or may be separate and accessed through other interface systems. Modem 247 may provide a direct connection to a remote server via a telephone link or to the Internet via an internet service provider (ISP). Network interface 248 may provide a direct connection to a remote server via a direct network link to the Internet via a POP (point of presence). Network interface 248 may provide such connection using wireless techniques, including digital cellular telephone connection, Cellular Digital Packet Data (CDPD) connection, digital satellite data connection or the like.

Many other devices or subsystems (not shown) may be connected in a similar manner (e.g., document scanners, digital cameras and so on). Conversely, all of the devices shown in FIG. 2 need not be present to practice the present disclosure. The devices and subsystems can be interconnected in different ways from that shown in FIG. 2. Code to implement the present disclosure may be stored in computer-readable storage media such as one or more of system memory 217, fixed disk 244, optical disk 242, or floppy disk 238. Code to implement the present disclosure may also be received via one or more interfaces and stored in memory. The operating system provided on computer system 200 may be MS-DOS®, MS-WINDOWS®, OS/2®, OS X®, UNIX®, Linux®, or another known operating system.

Power manager 250 may monitor a power level of battery 252. Power manager 250 may provide one or more APIs (Application Programming Interfaces) to allow determination of a power level, of a time window remaining prior to shutdown of computer system 200, a power consumption rate, an indicator of whether computer system is on mains (e.g., AC Power) or battery power, and other power related information. According to some embodiments, APIs of power manager 250 may be accessible remotely (e.g., accessible to a remote backup management module via a network connection). According to some embodiments, battery 252 may be an Uninterruptable Power Supply (UPS) located either local to or remote from computer system 200. In such embodiments, power manager 250 may provide information about a power level of an UPS.

Figure 3:
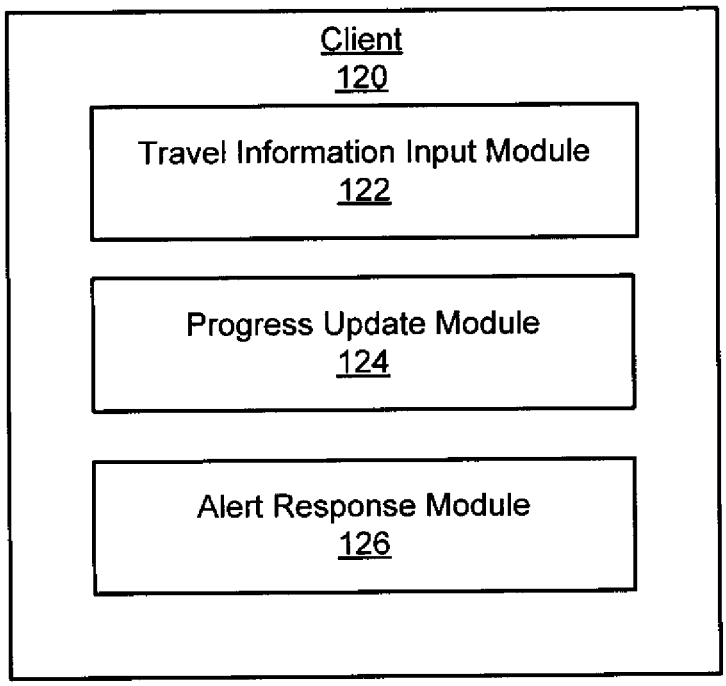
FIG. 3 shows modules of a client in accordance with an embodiment of the present disclosure.

FIG. 3 shows modules of a client 120 in accordance with an embodiment of the present disclosure. As illustrated, the client 120 may contain one or more components including a travel information input module 122, a progress update module 124, and an alert response module 128.

The description below describes network elements, computers, and/or components of a system and method for providing missed arrival notifications that may include one or more modules. As used herein, the term "module" may be understood to refer to computing software, firmware, hardware, and/or various combinations thereof. Modules, however, are not to be interpreted as software which is not implemented on hardware, firmware, or recorded on a processor readable recordable storage medium (i.e., modules are not software per se). It is noted that the modules are exemplary. The modules may be combined, integrated, separated, and/or duplicated to support various applications. Also, a function described herein as being performed at a particular module may be performed at one or more other modules and/or by one or more other devices instead of or in addition to the function performed at the particular module. Further, the modules may be implemented across multiple devices and/or other components local or remote to one another. Additionally, the modules may be moved from one device and added to another device, and/or may be included in both devices.

Travel information input module 122 may be configured to allow a user of a client device (e.g., client 120) to input travel information using the client device. Travel information may include any data that indicates any, or a combination, of an expected destination, an expected route to an expected destination, and an expected time of arrival. For example, a user may input travel information that indicates the user expects to arrive at a hotel in Bangkok, Thailand at 2 PM. In another example, a user may input travel information that indicates the user expects to arrive at an office building in Buenos Aires, Argentina at 6 AM and an expected route to the office building. In yet another example, a user may input travel information that indicates the user expects to arrive at a home in Mexico City, Mexico at 8 PM and an expected route to the home. Travel information input module 122 may transmit the travel information received to a notification system (e.g., server 140A).

Progress update module 124 may be configured to generate and transmit one or more progress updates to a notification system (e.g., server 140A). A progress update may include any data that indicates a current location of a client device (e.g., client 120) associated with a user, a current time associated with a current location, or a combination of both. In one embodiment, a progress update may include a geographic location (e.g., one or more longitudinal coordinates, one or more latitudinal coordinates) that indicates a client device's current position and a current time associated with the client device's current position. In another embodiment, a progress update may include an indication that a client device has arrived at a sub-destination along an expected route to an expected destination and a current time that indicates when the client device arrived at the sub-destination.

Alert response module 126 may be configured to receive an alert from a notification system (e.g., server 140A). The alert may request that a user associated with a client device (e.g., client 120) input a response to the alert using the alert response module 126. In one embodiment, an alert may request that a user respond to the alert by activating (e.g., clicking on) any button on an input device (e.g., keyboard) of a client device (e.g., client 120). In another embodiment, an alert may request that a user respond to the alert by inputting a code (e.g., security code) using an input device (e.g., keyboard) of a client device (e.g., client 120). For example, such a code may be defined during a subscription stage (e.g., when a user creates an account with a notification system). In another example, such a code may be provided to a user of a client device (e.g., client 120) by a notification system (e.g., server 140A). The alert response module 126 may transit any response provided by a user to a notification system (e.g., server 140A).

Alert response module 126 may be configured to detect if a user of a client device (e.g., client 120) has activated a covert distress signal. In one embodiment, detecting a covert distress signal may include detecting that one or more buttons on an input device of a client device (e.g., client 120) have been activated in a particular pattern (e.g., the "#" button is pressed followed by the "*" button being pressed). In another embodiment, detecting a covert distress signal may include detecting a particular motion (e.g., shaking the client device, turning the client device upside down, turning the client device over) of a client device (e.g., client 120). If a covert distress signal is detected, the alert response module 126 may notify a notification system (e.g., server 140A).

Figure 4:
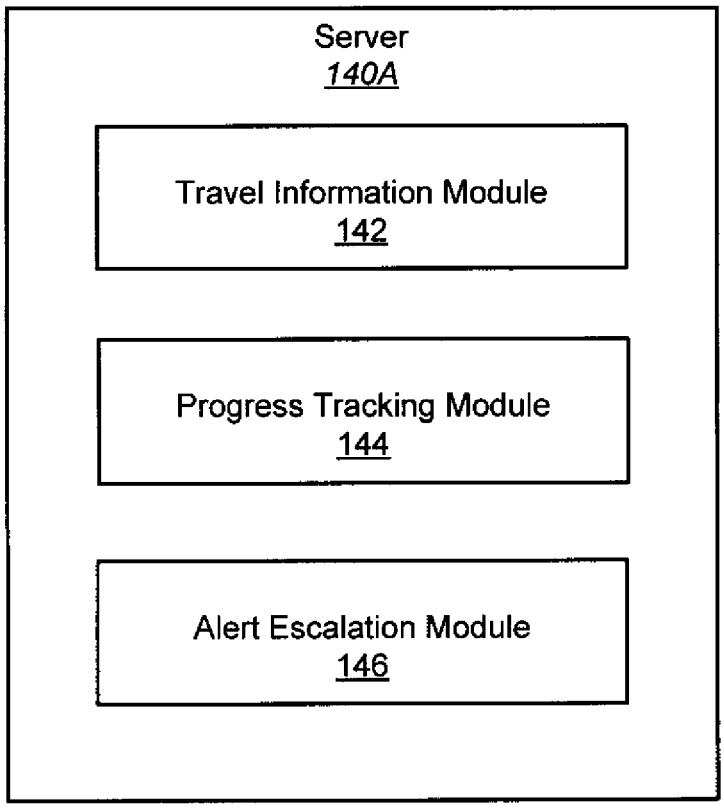
FIG. 4 shows modules of a server in accordance with an embodiment of the present disclosure.

FIG. 4 shows modules of a server 140A in accordance with an embodiment of the present disclosure. As illustrated, the server 140A may contain one or more components including a travel information module 142, a progress tracking module 144, and an alert escalation module 146.

The description below describes network elements, computers, and/or components of a system and method for providing missed arrival notifications that may include one or more modules. As used herein, the term "module" may be understood to refer to computing software, firmware, hardware, and/or various combinations thereof. Modules, however, are not to be interpreted as software which is not implemented on hardware, firmware, or recorded on a processor readable recordable storage medium (i.e., modules are not software per se). It is noted that the modules are exemplary. The modules may be combined, integrated, separated, and/or duplicated to support various applications. Also, a function described herein as being performed at a particular module may be performed at one or more other modules and/or by one or more other devices instead of or in addition to the function performed at the particular module. Further, the modules may be implemented across multiple devices and/or other components local or remote to one another. Additionally, the modules may be moved from one device and added to another device, and/or may be included in both devices.

Travel information module 142 may be configured to receive and store travel information from a plurality of client devices associated with a plurality of users. For example, the travel information module 142 may receive and store travel information that indicates a first user expects to arrive at a hotel in Bangkok, Thailand at 2 PM. In another example, the travel information module 142 may receive and store travel information that indicates a second user expects to arrive at an office building in Buenos Aires, Argentina at 6 AM and an expected route to the office building. In yet another example, the travel information module 142 may receive and store travel information that indicates a third user expects to arrive at a home in Mexico City, Mexico at 8 PM and an expected route to the home.

Progress tracking module 144 may be configured to initiate a tracking process based travel information received. A tracking process may track a user's progress (e.g., a client device's progress) in traveling to an expected destination. The tracking process may operate by receiving on or more progress updates (e.g., Global Position System (GPS) updates) from a corresponding client device (e.g., client 120) as the client device travels to the expected destination.

In one embodiment, the tracking progress may be configured to track that a client device (e.g., client 120) is generally headed toward an expected destination over time. In such an embodiment, the tracking process may track the progress of the client device in moving closer to the expected destination from one point-in-time to another point-in-time (e.g., a later point-in-time).

In another embodiment, the tracking process may be configured to track a user's progress (e.g., a client device's progress) on an expected route to an expected destination. In such an embodiment, the tracking process may track the progress of the client device in moving from one sub-destination (e.g., a destination along an expected route to an expected destination) to another sub-destination along the expected route to the expected destination. In another embodiment, the tracking process may be configured to determine whether a user (e.g., a client device) has arrived at an expected destination by an expected arrival time (e.g., an arrival timeframe).

Progress tracking module 144 may be configured to determine whether a user (e.g., a client device) has deviated from an expected route to an expected destination. Accordingly, the progress tracking module 144 may continuously compare an actual route of the user (e.g., the client device) to an expected route of the user (e.g., the client device). The actual route may be derived based on one or more progress updates provided by a corresponding client device.

In one embodiment, the progress tracking module 144 may determine whether the user has deviated from the expected route to the expected destination by applying a narrow travel range to the actual route. In another embodiment, the progress tracking module 144 may determine whether the user has deviated from the expected route to the expected destination by applying a wide travel range to the actual route. A travel range may indicate how much a user (e.g., client device) may stray from an expected route before it is considered a deviation. A narrow travel range may allow for a minimal amount of straying (e.g., no more than 100 yards from an expected route, no more than 200 yards from an expected route). A wide travel range may allow for a large amount of straying (e.g., 50 miles from an expected route, 100 miles from an expected route).

In certain embodiments, progress tracking module 144 may determine whether to apply a narrow travel range or a wide travel range based on conditions within a country in which a user (e.g., client device) is traveling. For example, progress tracking module 144 may determine to apply a narrow travel range based on a recent report that foreigners have been targeted for kidnappings within the country in which a user (e.g., client device) is currently traveling. In another example, progress tracking module 144 may determine to apply a wide travel range based on a report that indicates that kidnappings are not common within the country in which a user (e.g., client device) is currently traveling. In other embodiments, progress tracking module 144 may determine whether to apply a narrow travel range or a wide travel range based on preferences of a user or design preferences.

If, for example, the progress tracking module 144 determines that a user (e.g., client device) has deviated from an expected route, an alert escalation procedure may be invoked.

Alert escalation module 146 may be configured to invoke and execute an alert escalation procedure. An alert escalation procedure may include any, or a combination, of a first alert level, a second alert level, and a third alert level. That is, the alert escalation procedure may be configured to start at the first alert level, move next to the second alert level, and end at the third alert level or the alert escalation procedure may be configured to start or end at any of the first alert level, the second alert level, and the third alert level.

In one embodiment, the first alert level may include transmitting an alert to a client device (e.g., client 120) requesting that an associated user input a code (e.g., a security code). In such an embodiment, if the user fails to input the code (e.g., within a predetermined amount of time), the alert escalation procedure may proceed to the second alert level. In such an embodiment, if the traveler inputs a covert distress signal (e.g., by pressing a particular button), the alert escalation procedure may immediately notify one or more authorities (e.g., police authorities near the user's or client device's current location).

In another embodiment, the second alert level may include transmitting an alert to one or more third party systems (e.g., systems belonging to travel companions associated with a user, systems belonging to family members of a user, systems belonging to coworkers of a user, systems belonging to hotel workers located at a hotel at which a user is scheduled to stay). In such an embodiment, users of the third party systems may attempt to contact a user. If such contact is successful and the user is not in danger, the alert escalation procedure may end. If such contact is not successful, the alert escalation procedure may proceed to the third alert level.

In another embodiment, the third alert level may include notifying one or more authorities near a current location of a user (e.g., a client device). In such an embodiment, a current location of a user (e.g., client device) may be derived from one or more progress updates provided by the client device.

Alert escalation module 146 may also be configured to initiate an alert escalation procedure in the event a user (e.g., client device) fails to arrive at an expected destination by an expected time of arrival (e.g., within an arrival timeframe). Prior to initiating the alert escalation procedure and near the expected time of arrival, the alert escalation module 146 may request that a user indicate whether they have arrived at the expected destination using the client device (e.g., by entering a code). If, for example, the user indicates that they have arrived at the expected destination, the alert escalation module 146 may not invoke the alert escalation procedure. If, however, the user fails to indicate that they have arrived at the expected destination, the alert escalation module 146 may invoke the alert escalation procedure described above.

Figure 5A:
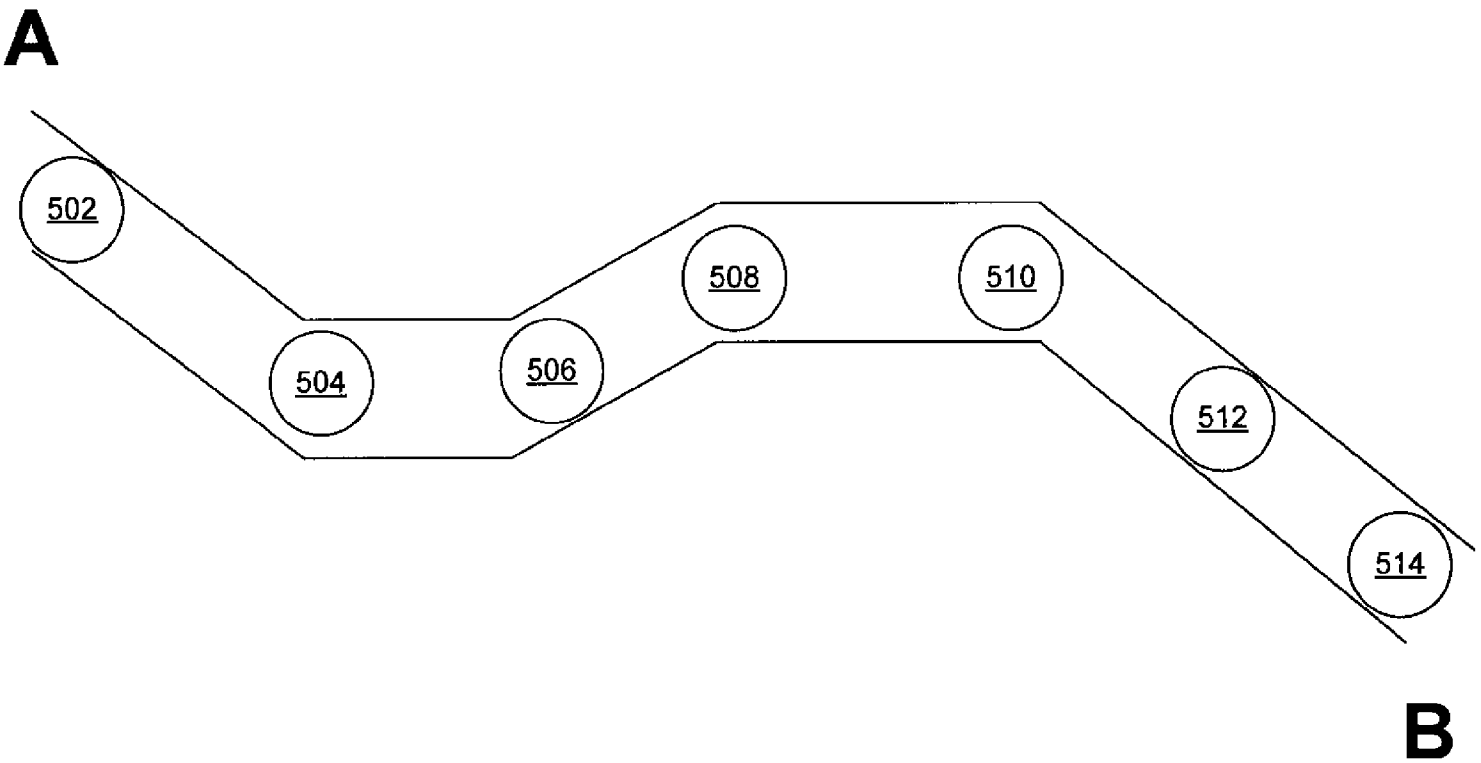
FIG. 5A shows an expected route to an expected destination in accordance with an embodiment of the present disclosure.

FIG. 5A shows an expected route 500 to an expected destination in accordance with an embodiment of the present disclosure. As illustrated in FIG. 5A, an expected route 500 may begin at Point A and end at an expected destination at Point B. The expected route 500 may include a plurality of sub-destinations 502, 504, 506, 508, 510, 512, 514 along the expected route 500. Accordingly, a notification system (e.g., server 140A) may track a user's progress (e.g., a client device's progress) in traveling to Point B by determining whether the user arrives at each of the plurality of sub-destinations 502, 504, 506, 508, 510, 512, 514 along the expected route 500.

Figure 5B:
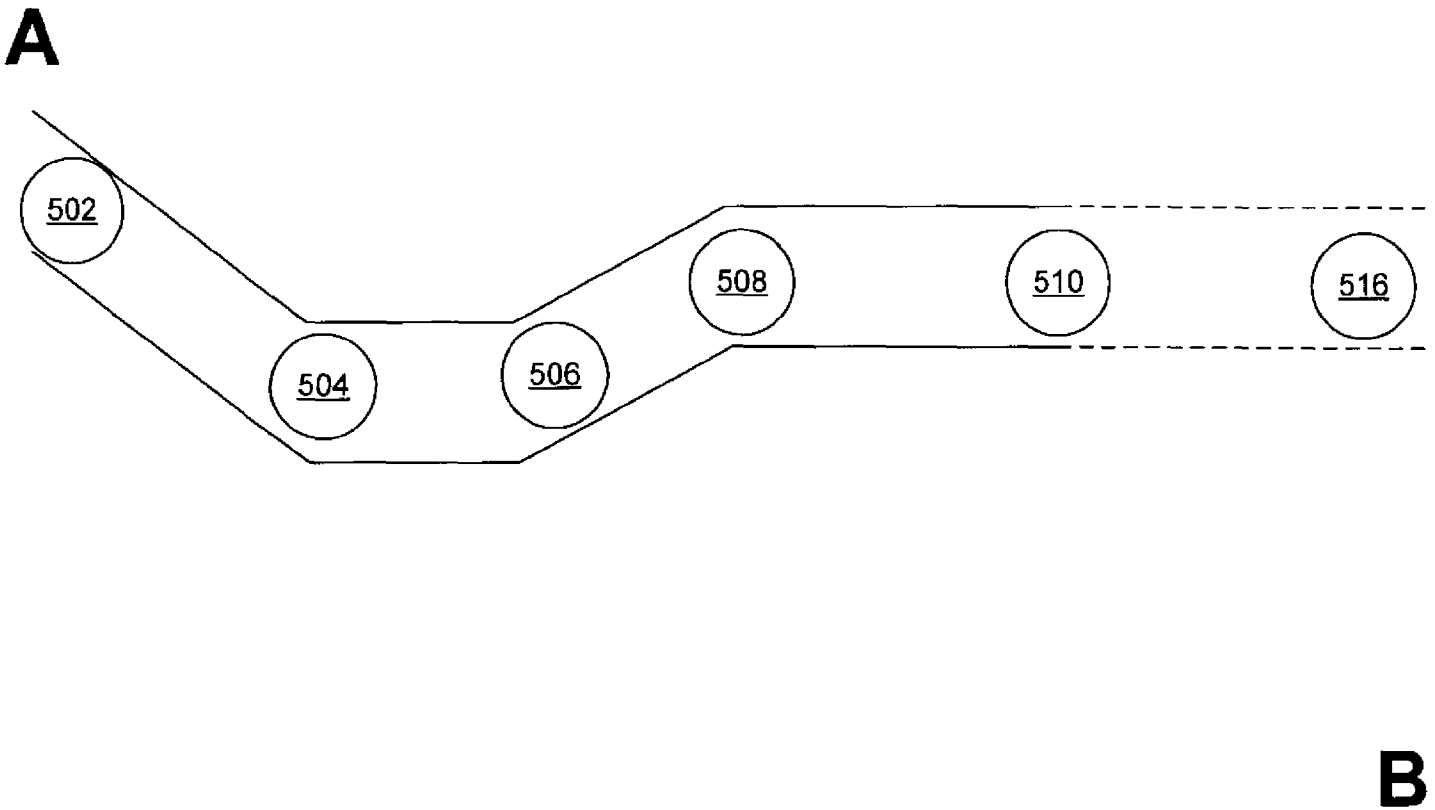
FIG. 5B shows an actual route to the expected destination in accordance with an embodiment of the present disclosure.

FIG. 5B shows an actual route 518 to the expected destination in accordance with an embodiment of the present disclosure. As illustrated in FIG. 5B, a user (e.g., client device) may deviate from an expected route as indicated by broken lines in FIG. 5B. Based on the illustrated deviation, a notification system (e.g., server 140A) may invoke an alert escalation procedure.

Figure 6:
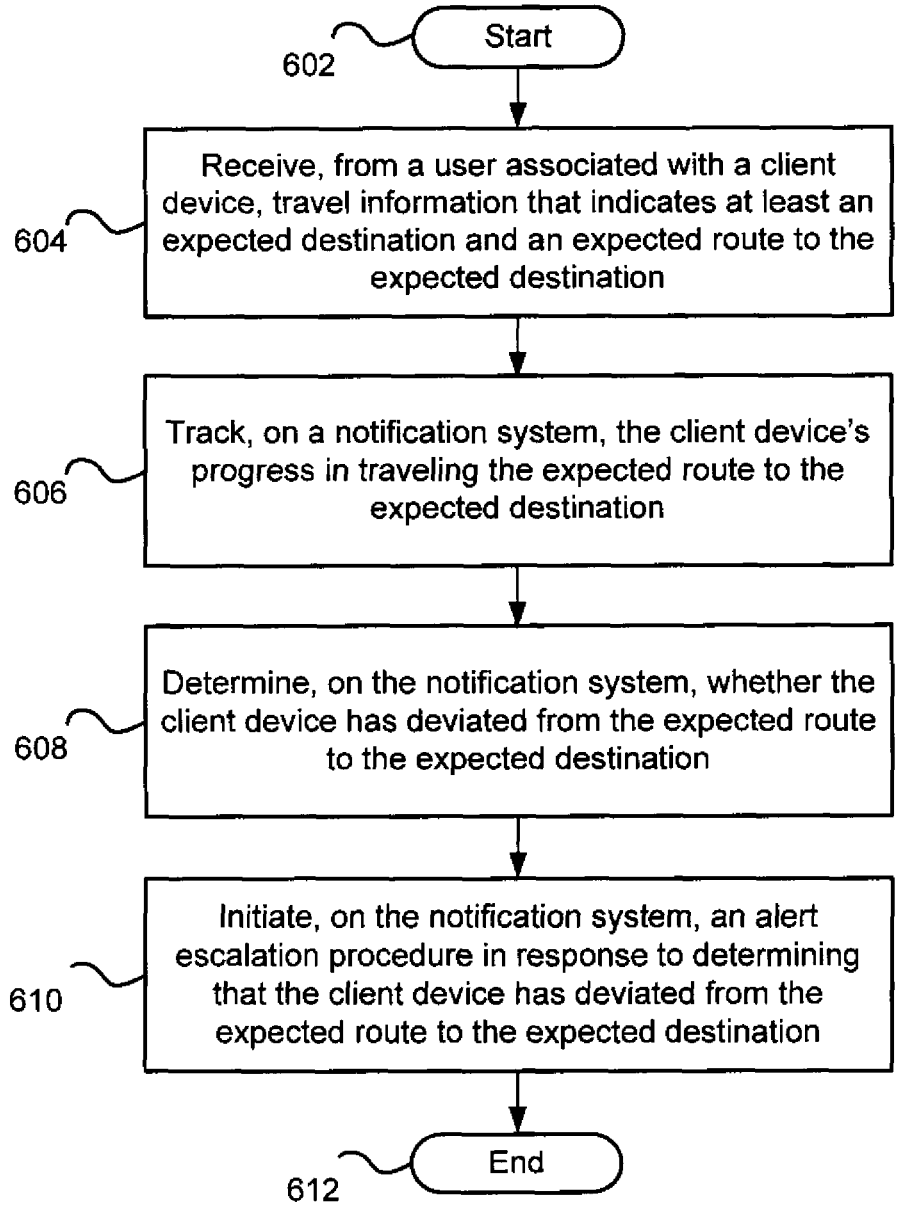
FIG. 6 depicts a method for providing missed arrival notifications in accordance with an embodiment of the present disclosure.

FIG. 6 depicts a method for providing missed arrival notifications in accordance with an embodiment of the present disclosure. The method 600 may begin at block 602.

At block 604, travel information that indicates at least an expected destination and an expected route to the expected destination is received from a user associated with a client device. For example, travel information that indicates that a user expects to arrive at a hotel in Bangkok, Thailand at 2 PM may be received. In another example, travel information that indicates that a user expects to arrive at an office building in Buenos Aires, Argentina at 6 AM and an expected route to the office building may be received. In yet another example, travel information that indicates that a user expects to arrive at a home in Mexico City, Mexico at 8 PM and an expected route to the home may be received.

At block 606, the client device's progress in traveling the expected route to the expected destination is tracked on a notification system. A tracking process may track the client device's progress in traveling to the expected destination. The tracking process may operate by receiving on or more progress updates (e.g., Global Position System (GPS) updates) from the client device as the client device travels to the expected destination.

At block 608, whether the client device has deviated from the expected route to the expected destination is determined on the notification system. In one embodiment, determining whether the client device has deviated from the expected route to the expected destination may include applying a narrow travel range to the actual route. In another embodiment, determining whether the client device has deviated from the expected route to the expected destination may include applying a wide travel range to the actual route.

At block 610, an alert escalation procedure is initiated on the notification system in response to determining that the client device has deviated from the expected route to the expected destination.

At block 612, the method 600 may end.

At this point it should be noted that providing missed arrival notifications in accordance with the present disclosure as described above may involve the processing of input data and the generation of output data to some extent. This input data processing and output data generation may be implemented in hardware or software. For example, specific electronic components may be employed in a progress tracking module or similar or related circuitry for implementing the functions associated with providing missed arrival notifications in accordance with the present disclosure as described above. Alternatively, one or more processors operating in accordance with instructions may implement the functions associated with providing missed arrival notifications in accordance with the present disclosure as described above. If such is the case, it is within the scope of the present disclosure that such instructions may be stored on one or more processor readable storage media (e.g., a magnetic disk or other storage medium), or transmitted to one or more processors via one or more signals embodied in one or more carrier waves.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Further, although the present disclosure has been described herein in the context of a particular implementation in a particular environment for a particular purpose, those of ordinary skill in the art will recognize that its usefulness is not limited thereto and that the present disclosure may be beneficially implemented in any number of environments for any number of purposes. Accordingly, the claims set forth below should be construed in view of the full breadth and spirit of the present disclosure as described herein.

The invention claimed is:

1. A method for providing missed arrival notifications comprising:

receiving, from a user associated with a client device, travel information that indicates at least an expected destination and an expected route to the expected destination;

tracking, on a notification system, the client device's progress in traveling the expected route to the expected destination;

determining, on the notification system, whether the client device has deviated from the expected route to the expected destination; and initiating, on the notification system, an alert escalation procedure in response to determining that the client device has deviated from the expected route to the expected destination, the alert procedure comprising:

a first alert level comprising transmitting an alert to the client device to request a response from the user, the first alert level occurring in response to initiating the alert escalation procedure, and a second alert level comprising transmitting one or more alerts to one or more third party systems, the second alert level occurring contingent on the user's response to the alert transmitted to the client device during the first alert level.

2. The method of claim 1, wherein the travel information indicates an expected time of arrival.

3. The method of claim 1, wherein the expected destination comprises a geographic location that is associated with geographic coordinates.

4. The method of claim 1, wherein tracking further comprises receiving one or more progress updates from the client device.

5. The method of claim 4, wherein determining further comprises comparing the expected route to an actual route.

6. The method of claim 5, wherein the actual route is derived based on the one or more progress updates.

7. The method of claim 5, wherein determining further comprises applying a narrow travel range to the actual route.

8. The method of claim 5, wherein determining further comprises applying a wide travel range to the actual route.

9. The method of claim 1, wherein the alert procedure further comprises a third alert level that comprises notifying an authority near a current location of the client device.

10. At least one non-transitory processor readable storage medium for storing a computer program of instructions configured to be readable by at least one processor for instructing the at least one processor to execute a computer process for performing the method as recited in claim 1.

11. The method of claim 1, wherein the second alert level occurs when an expected response is not received from the client device after the alert associated with the first alert level is transmitted to the client device.

12. The method of claim 9, wherein the alert procedure ends if a first predetermined response is received from the client device after the alert associated with the first alert level is transmitted to the client device;

the third alert level occurs if a second predetermined response different from the first predetermined response is received from the client device after the first alert level is transmitted to the client device; and the second alert level occurs if neither the first nor the second predetermined responses are received from the client device after the first alert level is transmitted to the client device.

13. The method of claim 12, wherein if the second alert level occurs, the third alert level occurs contingent on responses received during the second alert level.

14. An article of manufacture for providing missed arrival notifications, the article of manufacture comprising:

at least one non-transitory processor readable medium; and instructions stored on the at least one medium;

wherein the instructions are configured to be readable from the at least one medium by at least one processor and thereby cause the at least one processor to operate so as to:

receive, from a user associated with a client device, travel information that indicates at least an expected destination and an expected route to the expected destination;

track, on a notification system, the client device's progress in traveling the expected route to the expected destination;

determine, on the notification system, whether the client device has deviated from the expected route to the expected destination; and initiate, on the notification system, an alert escalation procedure in response to determining that the client device has deviated from the expected route to the expected destination, the alert procedure comprising:

a first alert level comprising transmitting an alert to the client device to request a response from the user, the first alert level occurring in response to initiating the alert escalation procedure, and a second alert level comprising transmitting one or more alerts to one or more third party systems, the second alert level occurring contingent on the user's response to the alert transmitted to the client device during the first alert level.

15. A system for providing missed arrival notifications comprising:

one or more processors communicatively coupled to a network, wherein the one or more processors are configured to:

receive, from a user associated with a client device, travel information that indicates at least an expected destination and an expected route to the expected destination;

track, on a notification system, the client device's progress in traveling the expected route to the expected destination;

determine, on the notification system, whether the client device has deviated from the expected route to the expected destination; and initiate, on the notification system, an alert escalation procedure in response to determining that the client device has deviated from the expected route to the expected destination, the alert procedure comprising:

a first alert level comprising transmitting an alert to the client device to request a response from the user, the first alert level occurring in response to initiating the alert escalation procedure, and a second alert level comprising transmitting one or more alerts to one or more third party systems, the second alert level occurring contingent on the user's response to the alert transmitted to the client device during the first alert level.

16. The system of claim 15, wherein the travel information indicates an expected time of arrival.

17. The system of claim 15, wherein the expected destination comprises a geographic location that is associated with geographic coordinates.

18. The system of claim 15, wherein the one or more processors are further configured to track by receiving one or more progress updates from the client device.

19. The system of claim 18, wherein the one or more processors are further configured to determine by comparing the expected route to an actual route.

20. The system of claim 19, wherein the actual route is derived based on the one or more progress updates.

* * * * *